US009150314B2

(12) United States Patent
Heath

(10) Patent No.: US 9,150,314 B2
(45) Date of Patent: Oct. 6, 2015

(54) HEADPHONE EAR TIP HOLDER

(71) Applicant: Thomas Lewis Heath, Glasgow (GB)

(72) Inventor: Thomas Lewis Heath, Glasgow (GB)

( * ) Notice: Subject to any disclaimer, the term of this patent is extended or adjusted under 35 U.S.C. 154(b) by 0 days.

(21) Appl. No.: 14/318,589

(22) Filed: Jun. 28, 2014

(65) Prior Publication Data

US 2015/0014204 A1 Jan. 15, 2015

(30) Foreign Application Priority Data

Jul. 2, 2013 (GB) ..... 1311820.3

(51) Int. Cl.

| | |
|---|---|
| ***B65D 25/10*** | (2006.01) |
| ***B65B 5/08*** | (2006.01) |
| ***H04R 1/10*** | (2006.01) |
| ***B65D 73/00*** | (2006.01) |

(52) U.S. Cl.

CPC ..... *B65B 5/08* (2013.01); *B65D 73/0042* (2013.01); *H04R 1/10* (2013.01)

(58) Field of Classification Search

CPC ..... B65D 73/0042; B65D 73/0035; B65D 73/005; B65D 71/72; B65D 25/10; H04R 1/1033; H04R 1/10

USPC ..... 206/486, 327, 563, 562, 565, 38; 381/384

See application file for complete search history.

(56) References Cited

U.S. PATENT DOCUMENTS

| | | | | |
|---|---|---|---|---|
| 4,184,592 | A | 1/1980 | Howard, Jr. | |
| 5,887,720 | A * | 3/1999 | Lin | 206/702 |
| D529,288 | S * | 10/2006 | Ham | D3/294 |
| 8,403,135 | B2 * | 3/2013 | Corry | 206/320 |
| D691,581 | S * | 10/2013 | Mercs et al. | D14/205 |
| 8,631,934 | B2 * | 1/2014 | Chun | 206/320 |
| D712,374 | S * | 9/2014 | Rajski | D14/205 |
| D720,718 | S * | 1/2015 | Stevinson | D14/205 |
| 2004/0007480 | A1 | 1/2004 | Pattee et al. | |
| 2011/0317865 | A1 * | 12/2011 | Stevinson | 381/384 |
| 2012/0128193 | A1 * | 5/2012 | Stevinson | 381/384 |
| 2013/0148839 | A1 * | 6/2013 | Stevinson | 381/384 |

FOREIGN PATENT DOCUMENTS

| | | | |
|---|---|---|---|
| DE | 102009050123 | A1 | 10/2010 |
| JP | H0928417 | A | 4/1997 |

* cited by examiner

*Primary Examiner* — Steven A. Reynolds

(74) *Attorney, Agent, or Firm* — One3 IP Management, P.C.; Jeromye V. Sartain

(57) ABSTRACT

A headphone ear tip holder includes a flat panel with a plurality of apertures, which are shaped for holding headphone ear tips securely.

9 Claims, 6 Drawing Sheets

HEADPHONE EAR TIP HOLDER

BACKGROUND

The present disclosure relates to a headphone ear tip holder and in particular to a device for storage and transportation of headphone ear tips.

Most in ear headphones use changeable ear tips for a secure fit and noise isolation. Ear tips are typically cylindrical and made of silicone or foam. Some in-ear headphones are accompanied with a wide range of ear tips, which are small and easily misplaced.

SUMMARY OF THE DISCLOSURE

According to a first aspect of the disclosure, there is provided a headphone ear tip holder comprising a flat panel with a plurality of apertures shaped to securely hold headphone ear tips.

According to a second aspect of the disclosure there is provided an assembly comprising a flat panel with a plurality of apertures, and one or more headphone ear tips engaged with apertures of the flat panel to be securely held thereby.

According to a third aspect of the disclosure there is provided a method of securing a headphone ear tip comprising placing the headphone ear tip within an aperture provided as part of a flat panel, and/or selectively removing the headphone ear tip from the panel.

BRIEF DESCRIPTION OF THE DRAWINGS

The disclosure will be described below, by way of example only, with reference to the accompanying drawings, in which.

DETAILED DESCRIPTION

The present disclosure proposes a headphone ear tip holder formed of a flat panel with a plurality of apertures shaped to securely hold headphone ear tips.

The panel is "flat" but will of course have some finite thickness. Typically it will be formed from steel or aluminum with a thickness of around 1 mm. It could also be formed from other metals, plastics, or any other suitable material.

Each aperture in the panel is designed to hold one ear tip. The plurality of apertures within the panel may each be the same size. However in alternative embodiments a panel may be provided with apertures having two or more different sizes.

Figure 1:
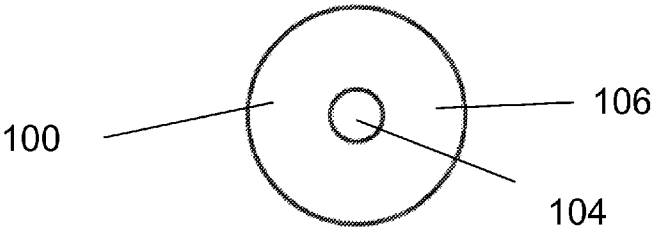
FIG. 1 shows a plan view of a first typical ear tip.
Figure 2:
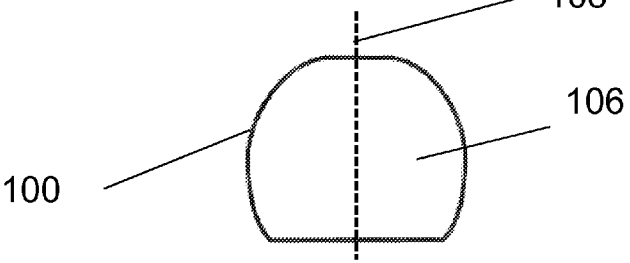
FIG. 2 shows an elevation view of the first typical ear tip.
Figure 3:
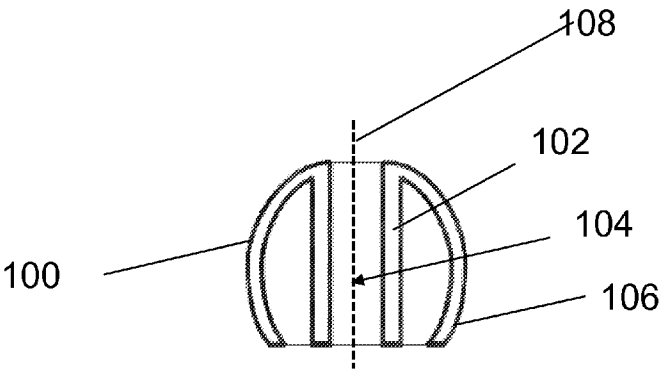
FIG. 3 shows a section through the first typical ear tip.

A headphone ear tip has a generally cylindrical form. A first typical ear tip is illustrated in FIGS. 1-3, with FIG. 1 showing a plan view, FIG. 2 showing an elevation view and FIG. 3 showing a section through the tip. The ear tip 100 comprises a cylindrical member 102 defining a central hollow cylindrical portion 104, and an outer body portion 106. A longitudinal axis 108 runs through the center of the ear tip 100 and is preferably aligned with the central axis of the hollow cylindrical portion 104. A bottom edge of the ear tip is longer than a top edge of the ear tip, as can be seen from FIGS. 2 and 3, where the flat portions at the top of the ear tip are shorter than the flat portions at the bottom of the ear tip.

The cylindrical member 102 and body portion 106 may be formed as integrated components in a one-piece molded form, or they may be separate components that are affixed together. Where they are separate components they may be formed of different materials or with different material characteristics, in which case the cylindrical member 102 may be of greater rigidity or thickness as compared with the outer body portion 106.

The outer body portion 106 forms a curtain around the cylindrical member 102, with an open space between them, as shown in FIG. 3.

Figure 4:
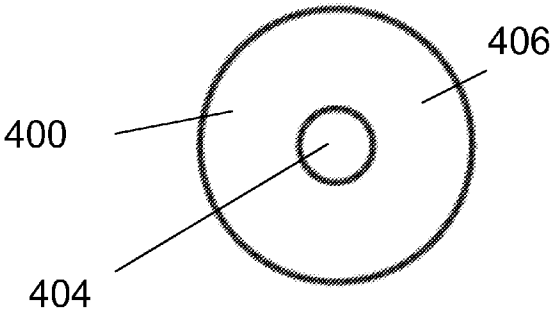
FIG. 4 shows a plan view of a second typical ear tip.
Figure 5:
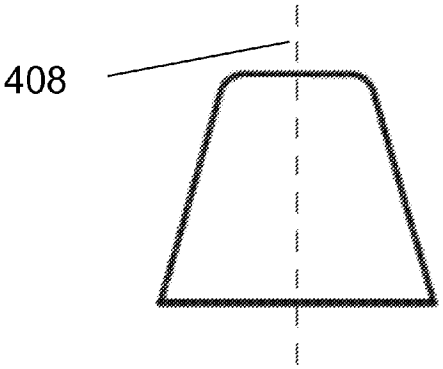
FIG. 5 shows an elevation view of the second typical ear tip.
Figure 6:
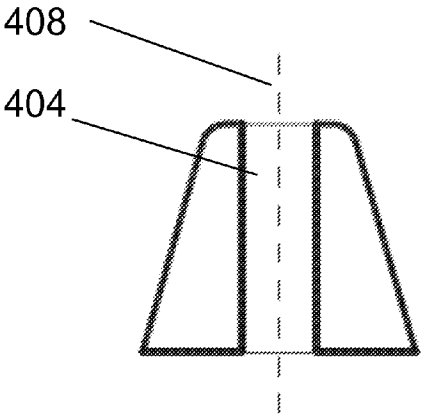
FIG. 6 shows a section through the second typical ear tip.

A second alternative ear tip 400 is shown in FIGS. 4-6, with FIG. 4 showing a plan view, FIG. 5 showing an elevation view and FIG. 6 showing a section through the tip 400. The tip 400 is solid except for a hollow cylindrical portion 404 about a longitudinal axis 408. The inner surface of the cylindrical portion 404 may define a cylindrical member, and may comprise a cylindrical portion of material which may be formed of a different material or have different material characteristics as compared with the body 406 of the tip 400, in which case the cylindrical member may be of greater rigidity or thickness as compared with the outer body portion 406. Alternatively, the body 406 of the tip 400 could be formed of a single material. A bottom edge of the ear tip 400 is longer than a top edge of the ear tip 400.

Figure 7:
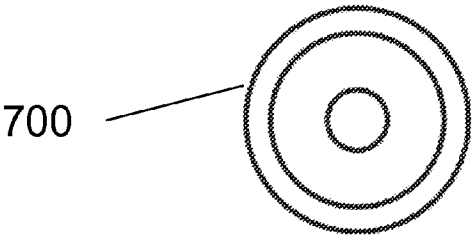
FIG. 7 shows a plan view of a third typical ear tip.
Figure 8:
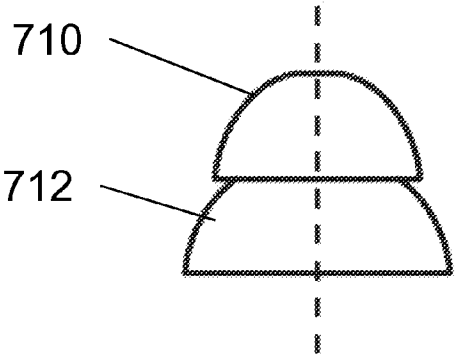
FIG. 8 shows an elevation view of the third typical ear tip.
Figure 9:
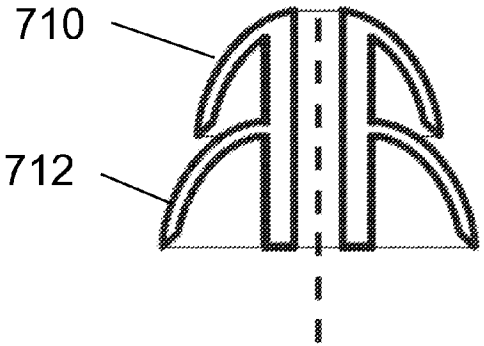
FIG. 9 shows a section through the third typical ear tip.

A third alternative ear tip 700 is shown in FIGS. 7-9, with FIG. 7 showing a plan view, FIG. 8 showing an elevation view and FIG. 9 showing a section through the tip 700. This is similar to the tip shown in FIGS. 1-3, except that a body portion comprises two separate flanges, a first flanged portion 710 and second flanged portion 712. A bottom edge of the ear tip 700 is longer than a top edge of the ear tip 700.

The ear tips illustrated in all the previous figures comprise body portions formed from compressible material, such as silicone or foam. They can be compressed by application of pressure such as that applied between a finger and thumb, and are also elastic so that they regain their shape after being released from a compressed state.

The tip designs shown in FIGS. 1-9 are only for illustrative purposes. The scope of the disclosure can accommodate other tip designs and these examples are not intended to limit the scope of the disclosure.

Figure 10:
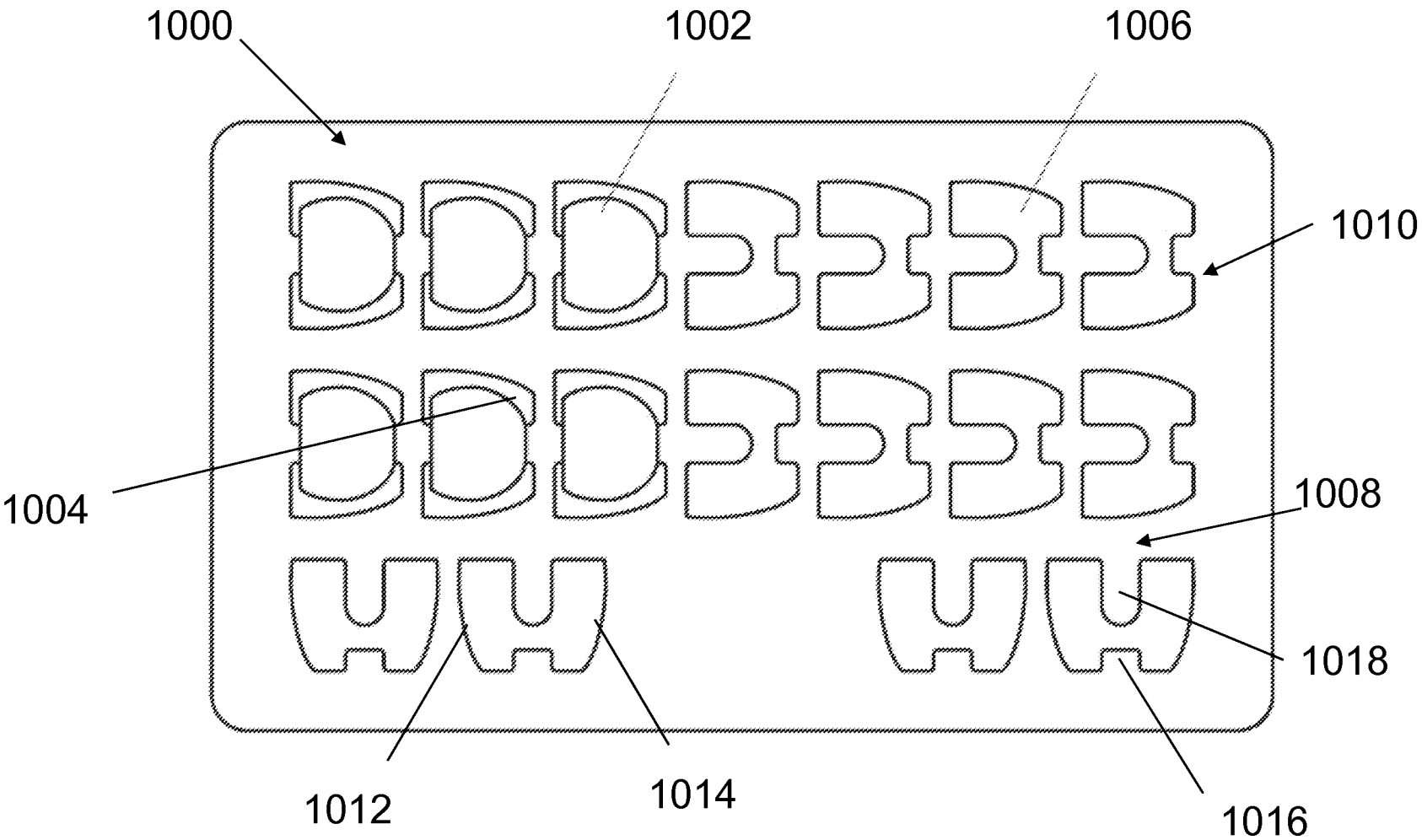
FIG. 10 shows an example of an ear tip holder according to the disclosure, in plan view.
Figure 11:
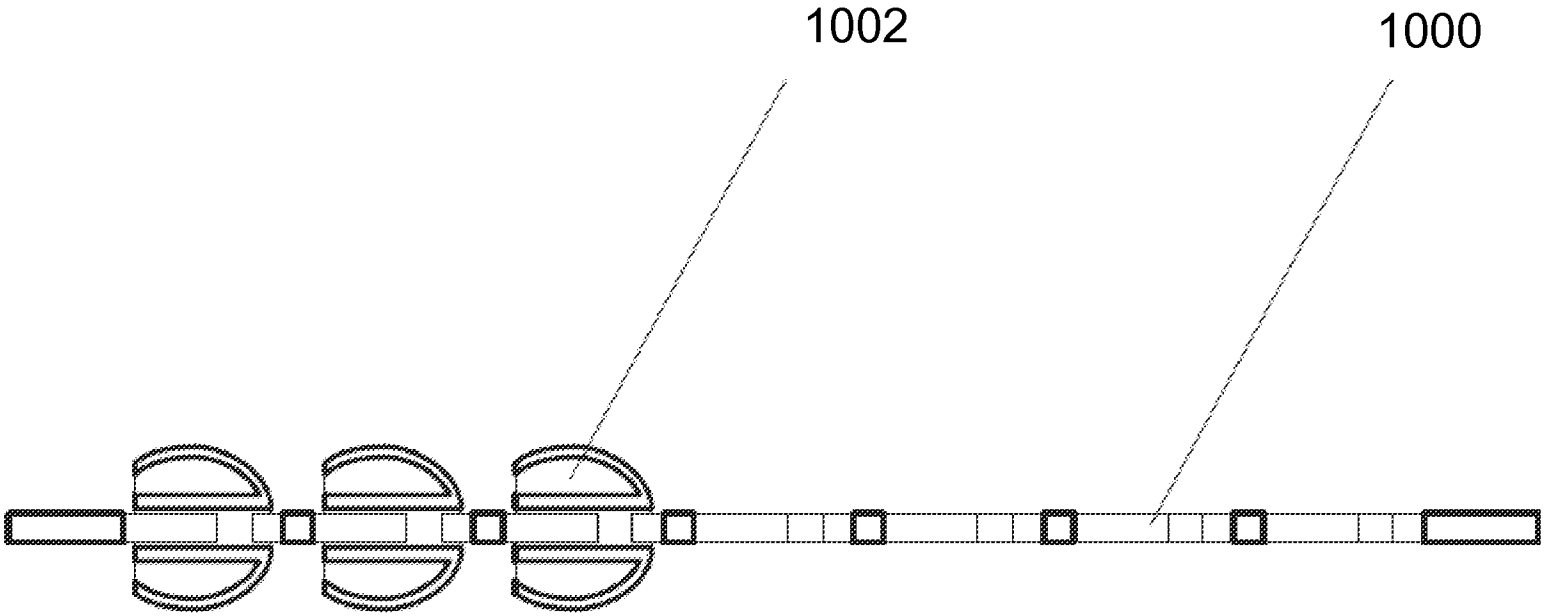
FIG. 11 shows a section through the same ear tip holder.

FIG. 10 shows an example embodiment of a headphone ear tip holder 1000. The holder 1000 is shown in use, with ear tips 1002 being held in apertures 1004. Some empty apertures 1006 are also illustrated. FIG. 11 shows a section through the same ear tip holder 1000.

When the ear tips 1002 are in their secured position, their longitudinal axes are in plane with the flat panel 1000. In some cases when the flat panel is held horizontally the ear tips will adopt a resting position in which their longitudinal axes are slightly offset with respect to the plane of the flat panel, but are still parallel with the plane.

The shape of the apertures 1006 has been carefully designed so that headphone ear tips can be held securely. The apertures 1006 each have a bottom edge 1008 and a top edge 1010, and the bottom edge is longer than the top edge. This echoes the shape of an ear tip to be held by the panel, which has a bottom edge longer than a top edge, and encourages and aids the user to align the ear tip with the aperture.

Advantageously, the bottom edge of the apertures can be longer than the top edge of the apertures by a ratio of about 3:2. This has been found to be advantageous for enabling a good fit with a wide range of ear tip shapes, sizes and designs.

The apertures may also comprise curved side profiles 1012, 1014 which further mimic the profile of an ear tip and which further encourage and aid the user to align the ear tip with the aperture.

In use, the ear tip is securely held by engagement with a first protruding portion 1016 and a second protruding portion 1018 defined by the shape of the aperture 1006. One end of an ear tip's hollow cylindrical portion engages with the second protruding portion 1018 and the other end of the ear tip's hollow cylindrical portion engages with the first protruding portion 1016.

It is preferred that the end of the ear tip's hollow cylindrical portion that is provided at the bottom edge of the ear tip engages with the protruding portion that is provided at the bottom edge of the aperture (and therefore that the end of the ear tip's hollow cylindrical portion that is provided at the top edge of the ear tip engages with the protruding portion that is provided at the top edge of the aperture) so that the general shape of the ear tip is aligned with the general shape of the aperture, but the ear tip could be inserted the other way round if desired and it would still be held securely between the protruding portions.

Because an ear tip is elastic, it can be brought into engagement with one of the protruding portions, compressed and then brought into engagement with the other of the protruding portions, and then released from compression so that it springs back to its original shape and is held securely by engagement of both the protruding portions with opposite ends of the hollow cylindrical portion of the ear tip. A user compresses the ear tips by squeezing them, for example between a finger and thumb.

To remove the ear tip, it is compressed again and then removed from engagement with the protruding portions.

The insertion or removal may be a smooth motion, with compression being performed at the same time as the other steps.

The protruding portions have ends with rounded profiles, which helps with ease of insertion and removal of ear tips 1002 from the holder 1000.

The second protruding portion 1018, which is provided at the bottom edge of the aperture 1006, is preferably longer than the first protruding portion 1016. This encourages and aids the user to insert the ear tip and to align it with the aperture.

Advantageously, the second protruding portion can be longer than the first protruding portion by a ratio of about 3:1. This has been found to be advantageous for enabling a good fit with a wide range of ear tip shapes, sizes and designs.

Figure 12:
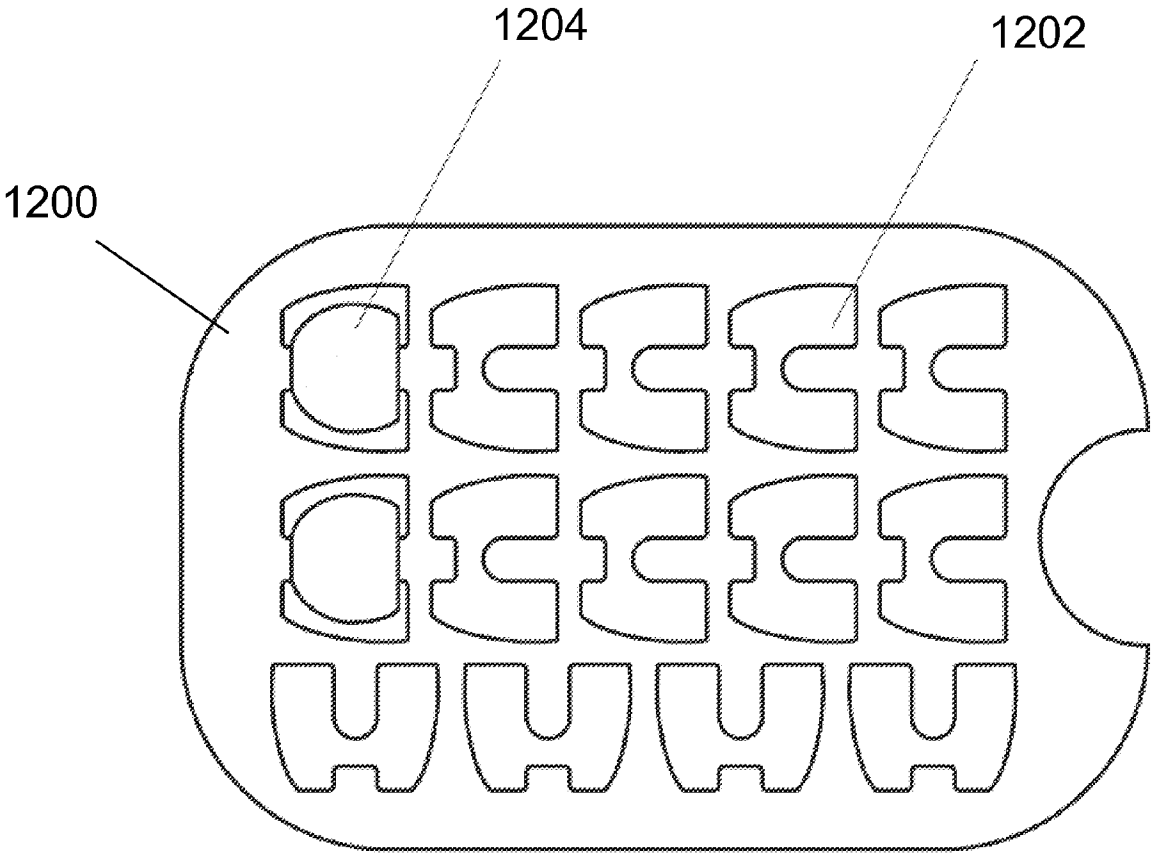
FIG. 12 shows a second example of an ear tip holder according to the disclosure, in plan view.

The flat panel may be of any desired shape, and may comprise any desired number of apertures. An example alternative embodiment is illustrated in FIG. 12, which shows a flat panel 1200 with apertures 1202 holding ear tips 1204.

The ear tip holder of the present disclosure enables easy storage and transportation of ear tips when not in use, and so reduces loss and damage to ear tips.

Various modifications and improvements can be made to the above without departing from the scope of the disclosure.

While aspects of the disclosure have been described with reference to at least one exemplary embodiment, it is to be clearly understood by those skilled in the art that the disclosure is not limited thereto. Rather, the scope of the disclosure is to be interpreted only in conjunction with the appended claims and it is made clear, here, that the inventor(s) believe that the claimed subject matter is the disclosure.

The invention claimed is:

1. A headphone ear tip holder comprising a flat panel with a plurality of apertures, wherein the apertures have a shape comprising:

a bottom edge and a top edge, and wherein the bottom edge is longer than the top edge;

a first protruding portion which protrudes from a center region of the top edge;

a second protruding portion which protrudes from a center region of the bottom edge;

a first curved side profile that runs from a first end of the bottom edge to a first end of the top edge; and a second curved side profile that extends from a second end of the bottom edge to a second end of the top edge.

2. The headphone ear tip holder of claim 1, wherein the apertures are shaped to hold headphone ear tips in a position wherein a central longitudinal axis of an ear tip is held within or parallel to the plane of the flat panel.

3. The headphone ear tip holder of claim 1, wherein the bottom edge is longer than the top edge by a ratio of about 3:2.

4. The headphone ear tip holder of claim 1, wherein the first protruding portion has an end with a rounded profile.

5. The headphone ear tip holder of claim 1, wherein the second protruding portion has an end with a rounded profile.

6. The headphone ear tip holder of claim 1, wherein the second protruding portion is longer than the first protruding portion.

7. The headphone ear tip holder of claim 1, wherein the second protruding portion is longer than the first protruding portion by a ratio of about 3:1.

8. A headphone ear tip holder comprising:

a flat panel with a plurality of apertures, each aperture having a shape comprising a first protruding portion and a second protruding portion; and one or more headphone ear tips being held within a respective aperture and secured by said first and second protruding portions, wherein said one or more headphone ear tips comprise a central longitudinal axis and a hollow cylindrical portion along said longitudinal axis, and wherein said first protruding portion of the flat panel is engaged with a first end of the hollow cylindrical portion, and said second protruding portion of the flat panel is engaged with a second end of the hollow cylindrical portion; and wherein the central longitudinal axis of the headphone ear tip is held within or parallel to the plane of the flat panel.

9. A headphone ear tip holder comprising:

a means for removably securing a plurality of headphone ear tips, wherein the securing means comprises a flat panel with a plurality of apertures, each aperture having a shape comprising a first protruding portion and a second protruding portion; and one or more headphone ear tips being held within the securing means, wherein said one or more headphone ear tips comprise a central longitudinal axis and a hollow cylindrical portion along said longitudinal axis, said first protruding portion of the flat panel is engaged with a first end of the hollow cylindrical portion, and said second protruding portion of the flat panel is engaged with a second end of the hollow cylindrical portion.

* * * * *